US007638961B2

(12) United States Patent
Hoshiba

(10) Patent No.: US 7,638,961 B2
(45) Date of Patent: Dec. 29, 2009

(54) DRIVE SYSTEM AND CONTROL METHOD OF THE SAME

(75) Inventor: Takeshi Hoshiba, Anjo (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 429 days.

(21) Appl. No.: 11/658,310

(22) PCT Filed: Jan. 13, 2006

(86) PCT No.: PCT/JP2006/300789

§ 371 (c)(1),
(2), (4) Date: Jan. 24, 2007

(87) PCT Pub. No.: WO2006/075795

PCT Pub. Date: Jul. 20, 2006

(65) Prior Publication Data

US 2008/0309165 A1 Dec. 18, 2008

(30) Foreign Application Priority Data

Jan. 17, 2005 (JP) ..... 2005-008983

(51) Int. Cl.
*H02P 1/04* (2006.01)

(52) U.S. Cl. ..... 318/430; 318/434; 307/10.1; 307/10.7; 361/29; 361/32; 123/179.1; 123/179.2

(58) Field of Classification Search ..... 123/179.1, 123/179.2, 179.4, 798 D; 307/10.6, 10.7; 361/29–32; 318/375–378, 430, 434
See application file for complete search history.

(56) References Cited

U.S. PATENT DOCUMENTS 4,338,896 A * 7/1982 Papasideris ..... 123/198 D
4,574,752 A * 3/1986 Reichert et al. ..... 123/198 DB
RE32,474 E * 8/1987 Reid ..... 307/10.1
5,072,702 A * 12/1991 Sasaki et al. ..... 123/179.4
5,408,211 A * 4/1995 Hall ..... 340/426.12
5,601,058 A * 2/1997 Dyches et al. ..... 123/179.2
5,642,696 A * 7/1997 Matsui ..... 123/179.1
5,698,907 A * 12/1997 Weber ..... 307/10.1
5,744,921 A 4/1998 Makaran
5,834,854 A * 11/1998 Williams ..... 307/10.6
6,473,562 B1 10/2002 Stephan (Continued)

FOREIGN PATENT DOCUMENTS

EP 0887179 12/1998

(Continued)

*Primary Examiner*—Paul Ip
(74) *Attorney, Agent, or Firm*—Oliff & Berridge, PLC

(57) ABSTRACT

In response to a system-off instruction, the drive system control technique of the invention controls individual motors of an electric cooling water pump and an electric cooling fan to stop (step S100), waits for elapse of a preset reference time period since start of the control of stopping the motors (step S110), and turns off a relay to disconnect a supply of electric power from a battery to a CPU of a control unit (step S120). Inactivation of the relay after elapse of the preset reference time period since start of the control of stopping the motor disconnects the supply of electric power to the control unit in the state of sufficiently low back emf generated by the motors. This arrangement effectively prevents malfunction of the control unit due to the back emf generated by the motors.

6 Claims, 1 Drawing Sheet

U.S. PATENT DOCUMENTS

| | | | | |
|---|---|---|---|---|
| 6,616,573 | B2 * | 9/2003 | McLeod et al. | 477/99 |
| 6,758,292 | B2 * | 7/2004 | Shoemaker | 180/53.6 |
| 6,768,221 | B2 * | 7/2004 | Klinger et al. | 307/10.7 |
| 7,053,500 | B2 * | 5/2006 | Furukawa et al. | 307/10.6 |
| 2002/0014216 | A1 * | 2/2002 | Boegner et al. | 123/179.3 |
| 2003/0080621 | A1 * | 5/2003 | Kirk | 307/10.7 |
| 2003/0117019 | A1 * | 6/2003 | Furukawa et al. | 307/10.6 |
| 2003/0151307 | A1 * | 8/2003 | Klinger et al. | 307/10.7 |

FOREIGN PATENT DOCUMENTS

| | | |
|---|---|---|
| GB | 2 081 533 A | 2/1982 |
| JP | 61-091042 | 5/1986 |
| JP | 6-55070 | 3/1994 |
| JP | U-06-034131 | 5/1994 |
| JP | A-09-149509 | 6/1997 |
| JP | 11-100234 | 4/1999 |
| JP | 2002-240186 | 8/2002 |
| JP | 2003-073146 | 3/2003 |
| JP | A-2004-137984 | 5/2004 |

* cited by examiner

DRIVE SYSTEM AND CONTROL METHOD OF THE SAME

The present invention relates to a drive system and a control method of the same. More specifically the invention pertains to a drive system including a motor that is driven with a supply of electric power from a certain power source and is capable of generating back emf (electromotive force), as well as to a control method of such a drive system.

BACKGROUND ART

A known drive system includes an electric cooling water pump and an electric cooling fan that are driven by individual motors to cool down an engine, and a control unit that controls the operations of the individual motors of the electric cooling water pump and the electric cooling fan (see, for example, Japanese Utility Model Laid-Open Gazette No. H06-34131). When the temperature of cooling water is still high at the timing of the operator's OFF operation of an ignition switch for system-off, the individual motors of the electric cooling water pump and the electric cooling fan continue operating to prevent overheat damages of the engine after the system-off.

DISCLOSURE OF THE INVENTION

A proposed technique for the drive system disconnects the supply of electric power from a battery to motor-driven electrical apparatuses, for example, an electric cooling water pump and an electric cooling fan, and to a control unit of controlling the motor-driven electrical apparatuses, in response to a system-off instruction. In this drive system, the motor-driven electrical apparatuses are arranged via a second relay in series with the control unit. The supply of electric power from the battery is given to the control unit via a first relay and to the motor-driven electrical apparatuses via both the first relay and the second relay. In response to a system-off instruction, this drive system first turns off the second relay to disconnect the supply of electric power to the motor-driven electrical apparatuses and cut off these motor-driven electrical apparatuses from the control unit, and then turns off the first relay to disconnect the supply of electric power to the control unit. This control strategy of the prior art drive system prevents malfunction of the control unit due to back emf generated by the continued rotations of the motors of the electrical apparatuses even after the disconnection of the power supply to the control unit. This prior art drive system requires an additional relay to cut off the motor-driven electrical apparatuses from the control unit and accordingly has the relatively complicated structure. Another possible structure of the drive system does not use the additional relay to cut off the motor-driven electrical apparatus from the control unit but arranges the motor-driven electrical apparatuses via the first relay in series with the control unit. In the drive system of this structure, however, the motors of the electrical apparatuses may continue rotating even after the disconnection of the power supply to the control unit in response to inactivation of the first relay. This may cause malfunction of the control unit by the back emf generated by the motors.

The drive system of the invention and its control method thus aim to prevent malfunction of a control unit in the event of output of a system-off instruction.

At least part of the above and the other related objects is attained by a drive system and a control method of the same of the invention having the configurations discussed below.

The present invention is directed to a first drive system including a motor that is driven with a supply of electric power from a certain power source and is capable of generating back emf. The drive system includes: a shutoff structure that disconnects the supply of electric power from the certain power source to the motor; and a control module that receives a supply of electric power from the certain power source via the shutoff structure, operates and controls at least the motor in a system-on state, and in response to a system-off instruction, controls the motor to stop and controls the shutoff structure to disconnect the supply of electric power from the certain power source after elapse of a preset reference time period since start of the control of stopping the motor.

The first drive system of the invention controls the motor to stop in response to a system-off instruction and controls the shutoff structure to disconnect the supply of electric power from the certain power source after elapse of the preset reference time period since start of the control of stopping the motor. The supply of electric power to the control module is disconnected after elapse of the preset reference time period since start of the control of stopping the motor. Namely the supply of electric power to the control module is disconnected in the state of sufficiently low back emf generated by the motor. This arrangement effectively prevents malfunction of the control module due to the back emf generated by the motor.

In the first drive system of the invention, the reference time period may be set to be longer than a time required for completely stopping rotation of a rotor in the motor. This arrangement ensures disconnection of the power supply to the control module after a complete stop of rotation of the rotor in the motor, that is, in the absence of back emf generated by the motor, thus more effectively preventing malfunction of the control module.

The present invention is also directed to a second drive system including a motor that is driven with a supply of electric power from a certain power source and is capable of generating back emf. The drive system includes: a shutoff structure that disconnects the supply of electric power from the certain power source to the motor; and a control module that receives a supply of electric power from the certain power source via the shutoff structure, operates and controls at least the motor in a system-on state, and in response to a system-off instruction, controls the motor to stop and controls the shutoff structure to disconnect the supply of electric power from the certain power source after confirmation of a complete stop of the motor.

In response to a system-off instruction, the second drive system of the invention controls the motor to stop and controls the shutoff structure to disconnect the supply of electric power from the certain power source after confirmation of a complete stop of the motor. The supply of electric power to the control module is disconnected after a complete stop of the motor, that is, in the absence of back emf generated by the motor. This arrangement effectively prevents malfunction of the control module due to the back emf generated by the motor.

The present invention is also directed to a first drive system control method of controlling a system-off in a drive system. The drive system includes a motor that is driven with a supply of electric power from a certain power source and is capable of generating back emf, a shutoff structure that disconnects the supply of electric power from the certain power source to the motor, and a control unit that receives a supply of electric power from the certain power source via the shutoff structure and operates and controls at least the motor. The first drive system control method includes the steps of: (a) controlling the motor to stop, in response to a system-off instruction; and (b) controlling the shutoff structure to disconnect the supply of electric power from the certain power source after elapse of a preset reference time period since start of the control of stopping the motor in the step (a).

The first drive system control method of the invention controls the motor to stop in response to a system-off instruction and controls the shutoff structure to disconnect the supply of electric power from the certain power source after elapse of the preset reference time period since start of the control of stopping the motor. The supply of electric power to the control unit is disconnected after elapse of the preset reference time period since start of the control of stopping the motor. Namely the supply of electric power to the control unit is disconnected in the state of sufficiently low back emf generated by the motor. This arrangement effectively prevents malfunction of the control unit due to the back emf generated by the motor.

In the first drive system control method of the invention, the reference time period in the step (b) may be longer than a time required for completely stopping rotation of a rotor in the motor. This arrangement ensures disconnection of the power supply to the control module after a complete stop of rotation of the rotor in the motor, that is, in the absence of back emf generated by the motor, thus more effectively preventing malfunction of the control module.

The present invention is also directed to a second drive system control method of controlling a system-off in a drive system. The drive system includes a motor that is driven with a supply of electric power from a certain power source and is capable of generating back emf, a shutoff structure that disconnects the supply of electric power from the certain power source to the motor, and a control unit that receives a supply of electric power from the certain power source via the shutoff structure and operates and controls at least the motor. The second drive system control method includes the step of: in response to a system-off instruction, controlling the motor to stop and controlling the shutoff structure to disconnect the supply of electric power from the certain power source after confirmation of a complete stop of the motor.

The second drive system control method of the invention controls the motor to stop and controls the shutoff structure to disconnect the supply of electric power from the certain power source after confirmation of a complete stop of the motor. The supply of electric power to the control module is disconnected after a complete stop of the motor, that is, in the absence of back emf generated by the motor. This arrangement effectively prevents malfunction of the control module due to the back emf generated by the motor.

BEST MODES OF CARRYING OUT THE INVENTION

Figure 1:
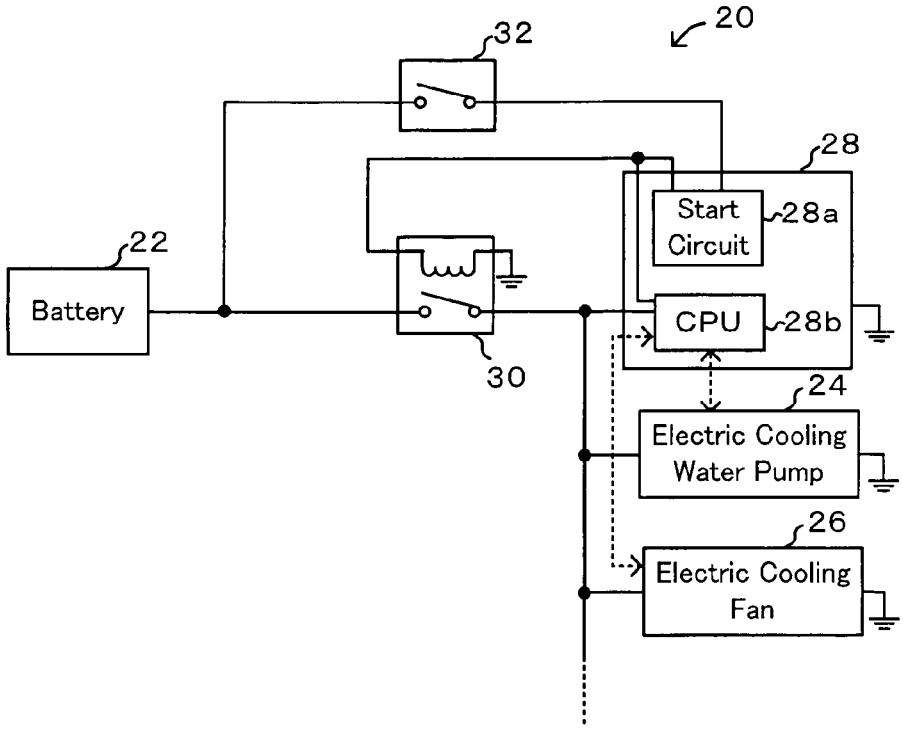
FIG. 1 schematically illustrates the configuration of a drive system, especially its power supply arrangement, to drive individual motors of electric equipment mounted on an automobile in one embodiment of the invention.

One mode of carrying out the invention is described below as a preferred embodiment. FIG. 1 schematically illustrates the configuration of a drive system 20, especially its power supply arrangement, to drive individual motors of electric equipment, for example, an electric cooling water pump, mounted on an automobile in one embodiment of the invention. The drive system 20 of the embodiment includes an electric cooling water pump 24 and an electric cooling fan 26 that are driven with a supply of electric power from a battery 22 as a power source, diversity of other motor-driven electrical apparatuses (not shown), a control unit 28 that controls the operations of the electric cooling water pump 24 and the electric cooling fan 26, a relay 30 that disconnects the supply of electric power from the battery 22 to the electric cooling water pump 24, the electric cooling fan 26, and the control unit 28, and a switch 32 that is interlocked with a non-illustrated ignition switch operable by a driver and is driven to disconnect the supply of electric power from the battery 22 to the control unit 28.

The electric cooling water pump 24 and the electric cooling fan 26 are driven with power of conventional motors and are operated and controlled by the control unit 28. Each of the individual motors drives and rotates an inner rotor (not shown) with a supply of electric power from the battery 22 via a driving circuit (not shown) to generate power, and is capable of generating back emf (electromotive force) through the rotation of the rotor.

The control unit 28 includes a start circuit 28*a* that turns on the relay 30 in response to a supply of electric power from the battery 22 via the switch 32, and a CPU 28*b* that receives a supply of electric power from the battery 22 via the relay 30 and controls the relay 30, the electric cooling water pump 24, and the electric cooling fan 26. The CPU 28*b* receives signals required for operating and controlling the electric cooling water pump 24 and the electric cooling fan 26, for example, signals from non-illustrated rotational position detection sensors to detect rotational positions of respective rotors in individual motors (not shown) of the electric cooling water pump 24 and the electric cooling fan 26. The CPU 28*b* outputs control signals to the respective driving circuits (not shown) for the individual motors of the electric cooling water pump 24 and the electric cooling fan 26 and control signals to turn on and off the relay 30.

In the drive system 20 of the embodiment constructed as described above, in response to the driver's ON operation of the ignition switch, the switch 32 is activated to connect the power supply from the battery 22 to the start circuit 28*a* of the control unit 28 and turn on the relay 30. The actuation of the relay 30 connects the supply of electric power from the battery 22 to the CPU 28*b*, the electric cooling water pump 24, the electric cooling fan 26, and the non-illustrated other electrical apparatuses to activate the CPU 28*b* and drive the individual motors of the electric cooling water pump 24 and the electric cooling fan 26 in response to the control signals output from the CPU 28*b*.

Figure 2:
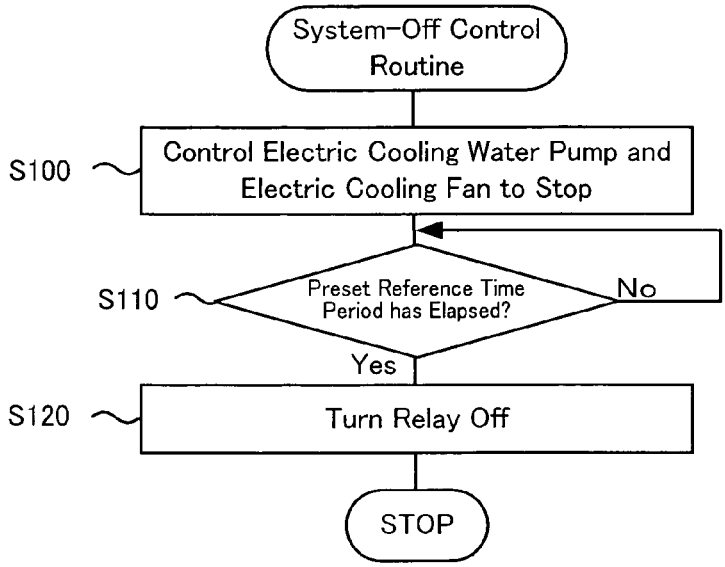
FIG. 2 is a flowchart showing a system-off control routine executed by a control unit included in the drive system of FIG. 1.

The description regards the operations of the drive system 20 having the above configuration, especially a series of control operations in response to the driver's system-off instruction. FIG. 2 is a flowchart showing a system-off control routine executed by the control unit 28. This control routine is executed immediately after inactivation of the switch 32 in response to the driver's OFF operation of the ignition switch.

In the system-off control routine of FIG. 2, the CPU 28*b* of the control unit 28 sends control signals to the driving circuits to stop the individual motors of the electric cooling water pump 24 and the electric cooling fan 26 (step S100) and waits for elapse of a preset reference time period since the start of the processing at step S100, that is, start of the control of stopping the motors of the electric cooling water pump 24 and the electric cooling fan 26 (step S110). After elapse of the reference time period, the CPU 28*b* of the control unit 28 turns off the relay 30 to disconnect the supply of electric power from the battery 22 to the CPU 28*b* (step S120). The CPU 28 then exits from this system-off control routine. The reference time period at step S110 is set to be slightly longer than an estimated time necessary for completely stopping the rotations of the rotors in the individual motors of the electric cooling water pump 24 and the electric cooling fan 26. The relay 30 is turned off after elapse of the preset reference time period since the start of control of stopping the individual motors of the electric cooling water pump 24 and the electric cooling fan 26. Even under control of stopping the individual motors of the electric cooling water pump 24 and the electric cooling fan 26, the rotors in the individual motors continue rotating by the law of inertia and generate back emf. The disconnection of the power supply to the CPU 28*b* of the control unit 28 in the presence of back emf may cause malfunction of the CPU 28*b* by application of the back emf. Inactivation of the relay 30 after elapse of the preset reference time period since the start of control of stopping the individual motors disconnects the power supply to the CPU 28*b* of the control unit 28 in the state of sufficiently low back emf. This arrangement thus effectively prevents malfunction of the CPU 28*b* or the control unit 28 due to the back emf generated by the motors.

As described above, the drive system 20 of the embodiment turns off the relay 30 after elapse of the preset reference time period since the start of control of stopping the individual motors of the electric cooling water pump 24 and the electric cooling fan 26. Such system-off control turns off the relay 30 and disconnects the power supply to the CPU 28*b* of the control unit 28 in the state of sufficiently low back emf generated by the motors. This arrangement effectively prevents malfunction of the control unit 28 due to the back emf generated by the motors. The drive system 20 of the embodiment does not require additional relays to cut off the electric cooling water pump 24 and the electric cooling fan 26 from the control unit 28 and accordingly has the simplified structure.

In the drive system 20 of the embodiment, the reference time period at step S110 is set to be slightly longer than the estimated time necessary for completely stopping the rotations of the rotors in the individual motors of the electric cooling water pump 24 and the electric cooling fan 26. As long as the back emf generated by the motors is decreased to a sufficiently low level not to cause malfunction of the CPU 28 of the control unit 28, the reference time period may be shorter than the estimated time necessary for completely stopping the rotations of the rotors in the individual motors.

In the drive system 20 of the embodiment, the system-off control turns off the relay 30 after elapse of the preset reference time period (steps S110 and S120). A modified flow of the system-off control may turn off the relay 30 after confirmation of the stop of rotations of the rotors in the individual motors based on signals from rotational position detection sensors (not shown) to detect the rotational positions of the rotors in the individual motors. This arrangement disconnects the power supply to the CPU 28*b* of the control unit 28 in the absence of back emf generated by the motors and thus more effectively prevents malfunction of the control unit 28.

The drive system 20 of the embodiment includes multiple motor-driven electrical apparatuses, such as the electric cooling water pump 24 and the electric cooling fan 26. The drive system may include only one motor-driven electrical apparatus.

In the drive system 20 of the embodiment, one identical control unit 28 controls the electric cooling water pump 24, the electric cooling fan 26, and the relay 30. The drive system may have multiple control units to individually control the electric cooling water pump 24, the electric cooling fan 26, and the relay 30.

The drive system 20 is mounted on the automobile in the structure of the embodiment but may be mounted on any of various machines and equipment other than the automobile.

The embodiment and its modifications discussed above are to be considered in all aspects as illustrative and not restrictive. There may be many other modifications, changes, and alterations without departing from the scope or spirit of the main characteristics of the present invention.

INDUSTRIAL APPLICABILITY

The technique of the invention is preferably applicable to manufacturing industries of drive systems.

The invention claimed is:

1. A drive system including a motor that is driven with a supply of electric power from a certain power source and is capable of generating back emf, said drive system comprising:

a shutoff structure that disconnects the supply of electric power from the certain power source to the motor; and a control module that receives a supply of electric power from the certain power source via the shutoff structure, the shutoff structure being turned on by a start circuit in response to the supply of electric power from the certain power source via a switch that is connected in parallel to the shutoff structure to provide the supply of electric power to the control module in a system-on state, the control module operates and controls at least the motor in the system-on state, and in response to a system-off instruction, controls the motor to stop and controls the shutoff structure to disconnect the supply of electric power from the certain power source after elapse of a preset reference time period since start of the control of stopping the motor.

2. A drive system in accordance with claim 1, wherein the reference time period is set to be longer than a time required for completely stopping rotation of a rotor in the motor.

3. A drive system including a motor that is driven with a supply of electric power from a certain power source and is capable of generating back emf, said drive system comprising:

a shutoff structure that disconnects the supply of electric power from the certain power source to the motor; and a control module that receives a supply of electric power from the certain power source via the shutoff structure, the shutoff structure being turned on by a start circuit in response to the supply of electric power from the certain power source via a switch that is connected in parallel to the shutoff structure to provide the supply of electric power to the control module in a system-on state, the control module operates and controls at least the motor in the system-on state, and in response to a system-off instruction, controls the motor to stop and controls the shutoff structure to disconnect the supply of electric power from the certain power source after confirmation of a complete stop of the motor.

4. A drive system control method of controlling a system-off in a drive system, said drive system including a motor that is driven with a supply of electric power from a certain power source and is capable of generating back emf, a shutoff structure that disconnects the supply of electric power from the certain power source to the motor, and a control unit that receives a supply of electric power from the certain power source via the shutoff structure, the shutoff structure being turned on by a start circuit in response to the supply of electric power from the certain power source via a switch that is connected in parallel to the shutoff structure to provide the supply of electric power to the control unit in a system-on state, the control unit operates and controls at least the motor, said drive system control method comprising the steps of:

(a) controlling the motor to stop, in response to a system-off instruction; and (b) controlling the shutoff structure to disconnect the supply of electric power from the certain power source after elapse of a preset reference time period since start of the control of stopping the motor in said step (a).

5. A drive system control method in accordance with claim 4, wherein the reference time period in said step (b) is longer than a time required for completely stopping rotation of a rotor in the motor.

6. A drive system control method of controlling a system-off in a drive system, said drive system including a motor that is driven with a supply of electric power from a certain power source and is capable of generating back emf, a shutoff structure that disconnects the supply of electric power from the certain power source to the motor, and a control unit that receives a supply of electric power from the certain power source via the shutoff structure, the shutoff structure being turned on by a start circuit in response to the supply of electric power from the certain power source via a switch that is connected in parallel to the shutoff structure to provide the supply of electric power to the control unit in a system-on state, the control unit operates and controls at least the motor, said drive system control method comprising the step of:

in response to a system-off instruction, controlling the motor to stop and controlling the shutoff structure to disconnect the supply of electric power from the certain power source after confirmation of a complete stop of the motor.

* * * * *